US007771804B2

(12) United States Patent
Ogata et al.

(10) Patent No.: US 7,771,804 B2
(45) Date of Patent: Aug. 10, 2010

(54) INKJET RECORDING MEDIUM

(75) Inventors: Yasuhiro Ogata, Fujinomiya (JP); Fuyuhiko Mori, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/920,686

(22) PCT Filed: May 18, 2006

(86) PCT No.: PCT/JP2006/310408

§ 371 (c)(1),
(2), (4) Date: Nov. 19, 2007

(87) PCT Pub. No.: WO2006/123830

PCT Pub. Date: Nov. 23, 2006

(65) Prior Publication Data

US 2009/0074996 A1 Mar. 19, 2009

(30) Foreign Application Priority Data

May 19, 2005 (JP) ..... 2005-146636

(51) Int. Cl.
*B41M 5/40* (2006.01)

(52) U.S. Cl. ..... 428/32.18; 428/32.2; 428/32.28; 428/32.31; 428/32.33; 428/32.34

(58) Field of Classification Search ..... 428/32.18, 428/32.2, 32.28, 32.31, 32.33, 32.34
See application file for complete search history.

(56) References Cited

U.S. PATENT DOCUMENTS

| | | | | |
|---|---|---|---|---|
| 6,436,515 | B1 | 8/2002 | Ohbayashi et al. | |
| 6,613,419 | B2 | 9/2003 | Ohbayashi et al. | |
| 2002/0025413 | A1 | 2/2002 | Ohbayashi et al. | |
| 2005/0147771 | A1 | 7/2005 | Kaneko et al. | |
| 2008/0075898 | A1 * | 3/2008 | Ogata et al. | 428/32.19 |

FOREIGN PATENT DOCUMENTS

| | | | |
|---|---|---|---|
| GB | 2 277 148 | A | 10/1994 |
| JP | 9-254524 | A | 9/1997 |
| JP | 10-119423 | A | 5/1998 |
| JP | 10-217601 | A | 8/1998 |
| JP | 2000-296667 | A | 10/2000 |
| JP | 2000-355160 | A | 12/2000 |
| JP | 2001-121809 | A | 5/2001 |
| JP | 2001-347748 | A | 12/2001 |
| JP | 2003-112471 | A | 4/2003 |
| JP | 2003-251915 | A | 9/2003 |
| JP | 2003-326838 | A | 11/2003 |
| JP | 2004-195723 | A | 7/2004 |
| JP | 2005-88333 | A | 4/2005 |
| JP | 2006-103103 | A | 4/2006 |
| WO | 2006/082712 | A1 | 8/2006 |

OTHER PUBLICATIONS

EP Communication, dated Mar. 31, 2009, issued in corresponding EP Application No. 06756568.9, 6 pages.

* cited by examiner

*Primary Examiner*—Betelhem Shewareged
(74) *Attorney, Agent, or Firm*—Sughrue Mion, PLLC

(57) ABSTRACT

An inkjet recording medium, including a support and an ink receiving layer formed on at least one face of the support, wherein the inkjet recording medium satisfies at least one of the following conditions (i) and (ii):

(i) the arithmetical mean deviation of the assessed profile Ra, as specified in JIS-B-0601(2001), of a surface of the ink receiving layer, determined with an evaluation length of 2.5 mm and a cutoff value of 0.8 mm, is 0.3 to 1.2 μm, and the peak value (reflectance) of the surface of the ink receiving layer, as determined by a goniophotometer, is in the range of 30 to 80%; and (ii) the arithmetical mean deviation of the assessed profile Ra, as specified in JIS-B0601(2001), of a surface of the support, determined with an evaluation length of 2.5 mm and a cutoff value of 0.8 mm, is 0.3 to 1.5 μm, and the peak value (reflectance) of the surface of the support, as determined by a goniophotometer, is in the range of 20 to 80%.

12 Claims, No Drawings

INKJET RECORDING MEDIUM

TECHNICAL FIELD

The present invention relates to a recording medium suitable for inkjet recording by using a liquid ink containing a dye or a pigment as a colorant, such as an aqueous or oil-based ink, or a solid ink that is solid at room temperature and is used for printing after it is liquefied by melting, and in particular, to an inkjet recording medium superior in ink receiving performance and appearance.

BACKGROUND ART

Recently, various information processing systems have been developed along with rapid development in the IT industry. Recording methods and devices suitable for these information processing systems have also been developed and variously put to practical use. Among the above-mentioned recording methods, inkjet recording methods can be used to record on many kinds of recording materials, and hardware (devices) therefor are comparatively low priced, compact, and very quiet. Therefore, the inkjet recording method has been widely used in the office as well as at home.

Further, with the increasing high resolution of inkjet printers in recent years, it has become possible to obtain so-called "photo-like" high-quality recorded products, and with the further developments in hardware (devices), inkjet recording sheets with improvements in various manners have been developed.

In general, examples of the properties required for inkjet recording sheets include (1) quick drying (high ink absorption speed), (2) ink dots having proper and uniform size (no bleeding), (3) excellent granularity, (4) high circularity of dots, (5) high color density, (6) high color saturation (no dullness), (7) excellent light fastness, and water resistance of printed portions, (8) a recording surface having a high degree of whiteness, (9) excellent storability of a recording medium (no yellow discoloration or image bleeding during long term storage), (10) resistance to deformation and excellent dimensional stability (sufficiently small curl), and (11) excellent running properties in hardware. Further, in addition to the above-mentioned properties, glossiness, surface flatness and texture similar to that of a silver salt photograph are required for use as photographic glossy paper used to obtain photograph-like high-quality recorded products.

In order to improve the various above properties, inkjet recording media with ink receiving layers of a porous structure have been developed for practical use. In the inkjet recording media, by using porous structures, high gloss with superior ink receivability (dryability) can be achieved.

For example, inkjet recording media have been proposed that include inorganic pigment fine particles, and water soluble resins, and have high void ratio ink receiving layers provided on a support (see, for example, Japanese Patent Application Laid-Open (JP-A) Nos. 10-119423 and 10-217601). These inkjet recording media, particularly, those having an ink receiving layer with a porous structure using silica as inorganic pigment fine particles have superior ink absorption ability due to the structure thereof, and exhibit both superior ink receivability (dryability) by which high definition images can be formed and show high gloss.

Generally among the inkjet recording media, a surface having high gloss called glossy surface is popular for photographic images, especially among amateur photographers, while a surface called semi-mat or semi-glossy surface is popular among professional and semi-professional (advanced amateur) photographers.

However, even with such a semi-glossy surface superior images in such properties as sharpness, sense of depth, and black depth are desired, but it is still insufficient in these properties, demanding further improvements. In particular, it has been difficult to obtain a high-quality images for photographic image taken under dark exposure conditions, such as night views.

In these circumstances, there were some proposals made that focus on the surface roughness of the coating layer, to further improve inkjet recording media in such properties. For example, inkjet recording media including a coating layer having a specified surface roughness are known (e.g., Japanese Patent Application Laid-Open (JP-A) Nos. 2000-355160, 2000-296667, and 2001-121809). In JP-A No. 2000-355160, the surface of the ink-absorbing layer roughened to a surface roughness Ra of 0.8 to 4.0 μm is disclosed and the glossiness is specified.

JP-A Nos. 2000-296667 and 2001-121809 both specify the glossiness and SRa of the support but are directed towards prevention of cracking of the ink receiving layer and improvement in adhesion between the ink receiving layer and the polyolefin layer.

JP-A Nos. 2000-355160, 2000-296667, and 2001-121809 simply relate to semi-mat surfaces or semi-glossy surfaces, and are not directed to providing technologies to give images superior in such properties as sharpness, sense of depth, and black depth, and in particular, to give high-quality images for photographic images taken under dark exposure conditions, such as night views.

DISCLOSURE OF INVENTION

The present invention has been made in view of the above circumstances and provides an inkjet recording medium.

An aspect of the invention provides an inkjet recording medium, including a support and an ink receiving layer formed on at least one face of the support, wherein the inkjet recording medium satisfies at least one of the following conditions (i) and (ii):

(i) the arithmetical mean deviation of the assessed profile Ra, as specified in JIS-B-0601(2001), of a surface of the ink receiving layer, determined with an evaluation length of 2.5 mm and a cutoff value of 0.8 mm, is 0.3 to 1.2 μm, and the peak value (reflectance) of the surface of the ink receiving layer, as determined by a goniophotometer, is in the range of 30 to 80%; and (ii) the arithmetical mean deviation of the assessed profile Ra, as specified in JIS-B-0601(2001), of a surface of the support, determined with an evaluation length of 2.5 mm and a cutoff value of 0.8 mm, is 0.3 to 1.5 μm, and the peak value (reflectance) of the surface of the support, as determined by a goniophotometer, is in the range of 20 to 80%.

BEST MODE FOR CARRYING OUT THE INVENTION

The inkjet recording medium according to the present invention is an inkjet recording medium including a support and an ink receiving layer formed on at least one face of the support, and the inkjet recording medium satisfies at least one of the following conditions (i) and (ii):

(i) the arithmetical mean deviation of the assessed profile Ra, as specified in JIS-B-0601(2001) (ISO 4287), of the ink-receiving layer surface, determined with the evaluation length of 2.5 mm and the cutoff value of 0.8 mm, is 0.3 to 1.2 μm, and the peak value (reflectance) of the ink-receiving layer surface, as determined by a goniophotometer, is in the range of 30 to 80%; and (ii) the arithmetical mean deviation of the assessed profile Ra, as specified in JIS-B-0601(2001) (ISO 4287), of the support surface, determined with the evaluation length of 2.5 mm and the cutoff value of 0.8 mm, is 0.3 to 1.5 μm, and the peak value (reflectance) of the support surface, as determined by a goniophotometer, is in the range of 20 to 80%.

An embodiment of the present invention is an inkjet recording medium satisfying condition (i).

Another embodiment of the present invention is an inkjet recording medium satisfying condition (ii).

Yet another embodiment of the present invention is an inkjet recording medium satisfying conditions (i) and (ii).

Hereinafter, the support and the respective layers of the inkjet recording medium according to the present invention will be described.

Ink Receiving Layer

In an embodiment of the inkjet recording medium of the present invention, the arithmetical mean deviation of the assessed profile Ra, as specified in JIS-B-0601(2001), of the ink receiving layer surface, determined with the evaluation length of 2.5 mm and the cutoff value of 0.8 mm, is 0.3 to 1.2 μm, and the peak value (reflectance) of the ink receiving layer surface, as determined by a goniophotometer, is in the range of 30 to 80%.

By controlling the arithmetical mean deviation of the assessed profile Ra and the peak value (reflectance) of the ink receiving layer as determined by a goniophotometer in the range above, it becomes possible to give bright indoor images at an EV value (Exposure Value) of 8 to 10 and bright outdoor images at an EV value of 10 to 16 that are superior in sharpness, sense of depth, and black depth. The advantageous effects of the invention are more significant with printed photographic images taken under lower exposure condition, i.e., images at a lower EV value, for example at an EV value of 8 or less, and even most significant especially with night view images at an EV value of 3 to 5 and indoor images taken under candle light at night. On the contrary, it is rather difficult to obtain such effects when the arithmetical mean deviation of the assessed profile Ra and the peak value (reflectance) of the ink receiving layer as determined by a goniophotometer are not in the range above.

As described above, the arithmetical mean deviation of the assessed profile Ra of the surface of the ink receiving layer according to the present invention may be 0.3 to 1.2 μm, and is preferably 0.35 to 1.2 μm and more preferably 0.40 to 1.2 μm.

The peak value (reflectance) of the ink receiving layer according to the present invention as determined by a goniophotometer may be in the range of 30 to 80%, and is preferably 30 to 75% and more preferably 30 to 70%.

The peak value (reflectance) as determined by a goniophotometer is a value obtained by measuring the ink receiving layer surface by using a goniophotometer under the following condition. An example of the goniophotometer is a three-dimensional goniophotometer GP-200 manufactured by Murakami Color Research Laboratory Co., Ltd.

(Condition)

Incident angle: 45 degree

Measurement range: −30 to 90 degree

For control of the arithmetical mean deviation of the assessed profile Ra and the peak value (reflectance) of the ink receiving layer as determined by a goniophotometer in the ranges above, it is preferable to prepare the support by using a chill roll of which the metal roll surface thereof is previously surface-roughened, for example by sand blasting or glass bead blasting, and metal-plated, thereby obtaining a support higher in the peak value (reflectance) as determined by a goniophotometer even if similar in the center line surface roughness. By using such a support, it is possible to obtain an ink receiving layer higher in the peak value (reflectance) as determined by a goniophotometer even if similar in the center line surface roughness. The method of preparing the support will be described below in detail.

The ink receiving layer preferably contains a water-soluble resin, a crosslinking agent, particles, a mordant, and other additives. Specifically, the ink receiving layer preferably contains at least one water-soluble resin selected from polyvinyl alcohol resins, cellulosic resins, ether bond-containing resins, carbamoyl group-containing resins, carboxyl group-containing resins, and gelatins, and additionally, at least one fine kind of particles selected from silica particles, colloidal silica, alumina particles, and pseudoboehmite. Hereinafter, an ink receiving layer having such a configuration will be described in detail. Other layers may be formed additionally on the support. In the present invention, the ink receiving layer is preferably formed on the support by the WOW method described below.

Hereinafter, main components for the ink receiving layer according to the present invention and the method of preparing the same will be described in detail.

—Particles—

The ink receiving layer according to the invention generally, preferably contains particles. Favorable examples of the particles include inorganic pigment particles, and examples of the inorganic pigment particles include silica particles, colloidal silica, titanium dioxide, barium sulfate, calcium silicate, zeolite, kaolinite, halloysite, mica, talc, calcium carbonate, magnesium carbonate, calcium sulfate, pseudoboehmite, zinc oxide, zinc hydroxide, alumina particles, aluminum silicate, calcium silicate, magnesium silicate, zirconium oxide, zirconium hydroxide, cerium oxide, lanthanum oxide, yttrium oxide, and the like. Among them, at least one kind of particles selected from silica particles, colloidal silica, alumina particles, and pseudoboehmite are preferable for forming a favorable porous structure. The particles may be used in the primary-particle state or in the secondary-particle state. The average primary-particle diameter of the particles is preferably 2 μm or less and more preferably 200 nm or less.

Further, silica particles having an average primary particle diameter of 20 nm or less, colloidal silica having an average primary particle diameter of 30 nm or less, alumina particles having an average primary particle diameter of 20 nm or less, and pseudoboehmite having an average pore radius of 2 to 15 nm are more preferable.

Silica particles are commonly classified roughly into wet method particles and dry method (gas phase process) particles according to the method of manufacture. By the wet method, silica particles are mainly produced by generating an activated silica by acid decomposition of a silicate, polymerizing to a proper degree the activated silica, and coagulating the resulting polymeric silica to give a hydrated silica. Alternatively by the gas phase process, vapor-phase process silica (anhydrous silica) particles are mainly produced by high-temperature gas-phase hydrolysis of a silicon halide (flame hydrolysis process), or by reductively heating and vaporizing quartz and coke in an electric furnace by applying an arc discharge and then oxidizing the vaporized silica with air (arc method). The "vapor-phase process silica" means an anhydrous silica particles produced by a gas phase process. In the present invention, the vapor phase silica is preferable.

The vapor-phase process silica is different in the density of silanol groups on the surface and the presence of voids therein and exhibits different properties from hydrated silica. The vapor-phase process silica is suitable for forming a three-dimensional structure having a higher void percentage. The reason is not clearly understood. In the case of hydrated silica particles have a higher density of 5 to 8 silanol groups/$nm^2$ on their surface. Thus the silica particles tend to coagulate densely. While the vapor phase process silica particles have a lower density of 2 to 3 silanol groups/$nm^2$ on their surface. Therefore, vapor-phase process silica seems to cause more scarce, softer coagulations (flocculates), consequently leading to a structure having a higher void percentage.

The vapor-phase process silica in the above has an extremely high specific surface area, and provides the ink receiving layer with a higher ink absorption and retention capacity. In addition, the vapor-phase process silica has a low refractive index, and thus if dispersed to a suitable particle diameter, provides the ink receiving layer with better transparency, and higher color density and favorable coloring is obtainable. The transparency of ink receiving layer is important from the viewpoint of obtaining a high color density and favorable coloring glossiness not only for applications wherein the transparency is required such as OHP sheets and the like, but also for applications as recording sheets such as photographic glossy papers and the like.

The average primary particles diameter of the vapor-phase process silica is preferably 30 nm or less, more preferably 20 nm or less, still more preferably 10 nm or less, and further preferably 3 to 10 nm. Since there is easy adhesion between the particles through the hydrogen bonding of the silanol groups in the vapor-phase process silica, if the average primary size of the particles is 30 nm or less, a structure with the high porosity ratio can be formed, and the ink absorption ability characteristics can be effectively raised.

The silica particles may be used together with other particles described above. If the vapor-phase silica above and another kind of particles are used together, the content of the vapor-phase silica in all particles is preferably 30% or more by mass, and more preferably 50% or more by mass.

Alumina particles, alumina hydrate, and the mixture or the complex thereof are also preferable as the inorganic particle above. Among them, alumina hydrate is preferable, because it absorbs and holds ink well, and in particular, pseudoboehmite ($Al_2O_3.nH_2O$) is preferable. Alumina hydrate may be used in a variety of forms, and is preferably prepared by using boehmite in the sol state as the raw material, because it provides a smooth layer more easily.

The average pore radius of the pseudoboehmite is preferably 1 to 30 nm and more preferably 2 to 15 nm. The pore volume thereof is preferably 0.3 to 2.0 ml/g and more preferably 0.5 to 1.5 ml/g. The average pore radius and the pore volume are determined by the nitrogen absorption/desorption method, for example, by using a gas absorption/desorption analyzer (e.g., brand name "OMNISORP 369", manufactured by Coulter).

Among alumina particles, gas-phase alumina particles having a greater specific surface area are preferable. The average primary particle diameter of the gas-phase alumina particle is preferably 30 nm or less and more preferably 20 nm or less.

When used on inkjet recording media, the particles above may be used in the manner similar to the embodiments disclosed, for example, in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777, and 2001-301314, and others.

—Water-Soluble Resin—

Examples of the water-soluble resins used for the ink receiving layer include resins having a hydroxy group as a hydrophilic constitutional unit such as polyvinyl alcohol (PVA), cation-modified polyvinyl alcohol, anion-modified polyvinyl alcohol, silanol-modified polyvinyl alcohol, polyvinylacetal, cellulosic resins [methylcellulose (MC), ethyl cellulose (EC), hydroxy ethyl cellulose (HEC), carboxy methyl cellulose (CMC), etc.], chitins, chitosans, and starch; hydrophilic ether bond-containing resins such as polyethylene oxide (PEO), polypropylene oxide (PPO), polyethylene glycol (PEG), and polyvinyl ether (PVE); hydrophilic amide group or amide bond-containing resins such as polyacrylamide (PAAM) and polyvinylpyrrolidone (PVP); and carbamoyl group-containing resins; and the like. In addition, resins having a carboxyl group as the dissociative group, such as polyacrylate salts, maleic acid resins, and alginate salts; gelatins, and the like, are also included. Among the resins, polyvinyl alcohol resins, cellulosic resins, ether bond-containing resins, carbamoyl group-containing resins are preferable, and polyvinyl alcohols are more preferable.

In order to prevent reduction of layer strength or layer cracking at the time when the layer is dried, due to too small a content of the water-soluble resin, and prevent reduction of ink absorbing ability caused by blocking of voids by resin due to too high a content of resin, the content of the water-soluble resin in the ink receiving layer is preferably 9 to 40%, more, preferably 12 to 33% by mass with respect to the total solid mass in ink receiving layer.

These water-soluble resins and the particles described above each may be a single-component substances or a combinations of multiple components.

From the viewpoint of preventing cracking of the layer, the number average polymerization degree of the polyvinyl alcohol is preferably 1800 or more, more preferably 2000 or more. From the view point of transparency of the layer, when water soluble resin is used in combination with the silica particles, the kind of water soluble resin is important. For combination with anhydrous silica, polyvinyl alcohol resins are preferable as the water-soluble resin. Among them, polyvinyl alcohol resins having a saponification degree of 70 to 99% are preferable.

Examples of the above polyvinyl alcohol include not only polyvinyl alcohol (PVA) but also cation-modified polyvinyl alcohol, anion-modified polyvinyl alcohol, silanol-modified polyvinyl alcohol, and other polyvinyl alcohol derivatives. It is possible to use one kind of polyvinyl alcohol on its own or combinations of two or more kinds of polyvinyl alcohols.

The above polyvinyl alcohols contain a hydroxyl group in a structural unit. Hydrogen bonding between the hydroxyl groups and the surface silanol groups on silica particles allows the silica particles to form a three-dimensional network structure having secondary particles as the network chain units. This three-dimensional network structure thus constructed seems to be the cause of easier development of an ink receiving layer having a porous structure having a higher void percentage.

In inkjet recording, the ink receiving layer having a porous structure obtained in this manner absorbs inks rapidly due to the capillary phenomenon, and provides printed dots superior in circularity without ink bleeding.

—Ratio of Particles to Water-Soluble Resin Contained—

The ratio (PB ratio: x/y, the mass of inorganic pigment particles to 1 part by mass of water soluble resin) of the mass of particles included (preferably silica particles; x) to the mass of water-soluble resin (y) has a great influence on the structure and strength of the ink receiving layer. A larger mass ratio (PB ratio) tends to result in increase in void percentage, pore volume, and surface area (per unit weight).

Specifically the PB ratio (x/y) for the ink receiving layer is preferably 1.5/1 to 10/1, from the viewpoints of suppressing the decrease in layer strength and prevention of cracking thereof when drying which may be caused due to an excessively high PB value, and preventing a decrease in void percentage and thus in ink absorptive property due to an larger amount of voids blocked more easily due to an excessively low PB ratio.

When conveyed in paper-conveying systems of inkjet printers, a stress may be applied to the inkjet recording medium. Accordingly, the ink receiving layer preferably has sufficiently high layer strength. Also from the viewpoints of preventing cracking, peeling, or the like of the ink receiving layer when the inkjet recording medium are cut into sheets, the ink receiving layer preferably has sufficiently high layer strength. Considering the above, the PB ratio is preferably 5/1 or less. On the other hand, from the viewpoint of ensuring the superior ink absorptive property in inkjet printers, the ratio is more preferably 2/1 or more.

For example, when a coating liquid, containing vapor-phase process silica particles, having an average primary particle diameter of 20 nm or less, and a water-soluble resin homogeneously dispersed in an aqueous solution at a PB ratio (x/y) of between 2/1 and 5/1, is applied and dried on a support, a three-dimensional network structure having the secondary particles of silica particles as the network chains is formed. Such a coating liquid easily provides a translucent porous layer having an average void diameter of 30 nm or less, a void percentage of 50 to 80%, a void specific volume of 0.5 ml/g or more, and a specific surface area of 100 $m^2/g$ or more.

—Crosslinking Agent—

With respect to the ink receiving layer according to the invention, it is preferable that the layer containing particles, a water-soluble resin, and the like, contains additionally a crosslinking agent that allows crosslinking of the water-soluble resin, and thus is a porous layer hardened by the crosslinking reaction between the crosslinking agent and the water-soluble resin.

The above crosslinking agent may be selected appropriately in relation to the water-soluble resin contained in the ink receiving layer, but boron compounds are preferable, as they allow faster crosslinking reaction. Examples of the boron compounds include borax, boric acid, borate salts [e.g., orthoborate salts, $InBO_3$, $ScBO_3$, $YBO_3$, $LaBO_3$, $Mg_3(BO_3)_2$, and $CO_3(BO_3)_2$], diborate salts [e.g., $Mg_2B_2O_5$, and $CO_2B_2O_5$], metaborate salts [e.g., $LiBO_2$, $Ca(BO_2)_2$, $NaBO_2$, and $KBO_2$], tetraborate salts [e.g., $Na_2B_4O_7.10H_2O$], pentaborate salts [e.g., $KB_5O_8.4H_2O$, $Ca_2B_6O_{11}.7H_2O$, and $CsB_5O_5$], and the like. Among them, borax, boric acid and borates are preferable since they are able to promptly cause a crosslinking reaction. Particularly, boric acid is preferable, and the combination of polyvinyl alcohol (water soluble resin) and boric acid is most preferred.

In the invention, the above crosslinking agent is preferably included to an amount of 0.05 to 0.50 parts by mass relative to 1 part by mass of the water soluble resin. More preferable is an inclusion amount of 0.08 to 0.30 parts by mass relative to 1 part by mass of the water soluble resin. If the amount of inclusion of the crosslinking agent is within the above ranges then the water soluble resin can be effectively crosslinked and development of cracks and the like can be prevented.

When gelatin and the like are used as a water-soluble resin in the invention, other compounds than the boron compounds, as described below, can be used for the crosslinking agent of the water-soluble resin.

Examples of such crosslinking agents include: aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine and 2,4-dichloro-6-S-triazine sodium salt; active vinyl compounds such as divinyl sulfonic acid, 1,3-vinylsulfonyl-2-propanol, N,N'-ethylenebis(vinylsulfonylacetamide) and 1,3,5-triacryloyl-hexahydro-S-triazine; N-methylol compounds such as dimethylolurea and methylol dimethylhydantoin; melamine resin such as methylolmelamine and alkylated methylolmelamine; epoxy resins; isocyanate compounds such as 1,6-hexamethylenediisocyanate; aziridine compounds such as those described in U.S. Pat. Nos. 3,017,280 and 2,983,611; carboxyimide compounds such as those described in U.S. Pat. No. 3,100,704; epoxy compounds such as glycerol triglycidyl ether; ethyleneimino compounds such as 1,6-hexamethylene-N,N'-bisethylene urea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chromium alum, potassium alum, zirconyl acetate and chromium acetate; polyamine compounds such as tetraethylene pentamine; hydrazide compounds such as adipic acid dihydrazide; and low molecular weight compounds or polymers containing at least two oxazoline groups. These crosslinking agent may be used alone, or in combinations of two or more thereof.

In the invention, the crosslinking agent can be supplied in a number of ways, such as when forming the ink receiving layer, the above crosslinking agents can be added to the ink receiving layer coating liquid and/or a coating liquid which is used for forming a layer adjacent and contacting the ink receiving layer. Or a coating liquid which includes the crosslinking agent can be applied in advance onto the support and the ink receiving layer coating liquid can be coated. Or, a solution of the crosslinking agent can be over-coated onto a coating of an ink receiving layer coating liquid which does not contain a crosslinking agent after it has dried. From the perspective of manufacturing efficiency, it is preferable that the crosslinking agent is added to the ink receiving layer coating liquid or a coating liquid for forming an adjacent contacting layer, and the crosslinking agent is supplied at the same time as forming the ink receiving layer. In particular, from the perspective of raising the print image density and glossiness of images, it is preferable to include the crosslinking agent in the coating liquid for the ink receiving layer. It is preferable that the concentration of the crosslinking agent in the ink receiving liquid coating layer is 0.05 to 10% by mass, and more preferably 0.1 to 7% by mass.

The crosslinking agent, for example the boron compound, is preferably added as follows. Here an example will be described where a boron compound is used. When the ink receiving layer is formed through curing by causing crosslinking of the coating layer obtained by applying an coating liquid (first coating liquid) for the ink receiving layer, the layer is cured by crosslinking by applying a basic solution (second coating liquid) having a pH value of 7.1 or more on the coating layer, either (1) at the same time for forming the coating layer by applying the first coating liquid; or (2) during the drying step of the coating layer formed by applying the first coating liquid and also before the coating layer exhibits a decreasing rate of drying. The boron compound acting as the crosslinking agent may be contained in either the first coating liquid or the second coating liquid, or alternatively may be contained in both the first coating liquid and the second coating liquid.

—Mordant—

In the invention, in order to raise the water resistance and resistance to the occurrence of bleeding with the passage in time of formed images, it is preferable that a mordant is added to an ink receiving layer. For the mordant can be used an inorganic mordant such as a cationic polymer (cationic mordant), or a inorganic mordant such as a water soluble metallic compound. Among these water soluble multi-valent metal salts are preferable.

Examples the water soluble multivalent metal salt compounds of the invention include water soluble salts of the following metals: calcium, barium, manganese, copper, cobalt, nickel, aluminum, iron, zinc, zirconium, chromium, magnesium, tungsten, molybdenum.

More specific examples thereof include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, copper II chloride, copper II ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminium sulfate, aluminum sulfite, aluminum thiosulfate, polychlorinated aluminum, aluminium nitrate nonahydrate, aluminium chloride hexahydrate, iron I bromide, iron I chloride, iron II chloride, iron II sulfate, iron II sulfate, zinc bromide, zinc chloride, zinc nitrate hexahydrate, zinc sulfate, zirconyl acetate, zirconium chloride, zirconium oxychloride octahydrate, zirconium hydroxychloride, chromium acetate, chromium sulfate, manganese sulfate, magnesium chloride hexahydrate, magnesium citrate nonahydrate, sodium phosphotungstate, sodium tungsten citrate, dodecatungstophosphoric acid n-hydrate, dodecatungstosilicic acid 26-hydrate, molybdenum chloride, dodecamolybdophosphoric acid n-hydrate, and the like.

For the above soluble multivalent metal salt compounds it is preferable to select one or more from soluble aluminum compounds, zirconium compounds or titanium compounds. For the above aluminum compounds, for example, inorganic salts such as aluminum chloride, or hydrates thereof, aluminum sulfate or hydrates thereof, and aluminum alum are known. Further more, there are inorganic based aluminum cationic polymers such as basic poly hydroxylated aluminum compounds. Basic poly hydroxylated aluminum compounds are preferable.

The basic poly hydroxylated aluminum compounds are water soluble polyhydroxylated aluminum compounds stably including multi-nucleated condensate ions, such as $[Al_6(OH)_{15}]^{3+}$, $[Al_8(OH)_{20}]^{4+}$, $[Al_{13}(OH)_{34}]^{5+}$, $[Al_{21}(OH)_{60}]$, of basic polymers basic polymers. They have as their main components the compounds show in the formula 1, 2 and 3 below.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)}\ 0<m<3n \quad \text{Formula 3}$$

These compounds can be easily obtained and are placed on the market, for example, by Taki Chemical Co. Ltd. as polychlorinated aluminum (PAC) as water treatment agents, by Asada Kagaku Co. Ltd. as polyhydrated aluminium (PAHO), also by Rikengreen Co. Ltd. as PURACHEM WT, by Taimei Chemicals Co. Ltd. as ALUFINE 83, TAIPACK, and ALUFINE 33, and other manufacturers for the same purpose. In the invention it is suitable to use the commercially available products directly. Since there are materials which have inappropriately low pH values, in these cases it is possible to use by suitably adjusting the pH.

For the zirconium compounds of the invention there are no particular limitations and various compounds can be used. Examples thereof include compounds of zirconyl acetate, zirconium chloride, zirconium oxychloride, zirconium hydroxychloride, zirconyl nitrate, basic zirconium carbonate, zirconium hydroxide, zirconium ammonium carbonate, zirconium potassium carbonate, zirconium sulphate, and zirconium fluoride. Zirconyl acetate is particularly preferable.

For the above titanium compounds, there are no particular limitations and various compounds can be used, for example titanium chloride, and titanium sulfate.

Since the pH of some of these compounds is inappropriately low, the pH can be adjusted to an appropriate value. In the invention, as a guide, the solubility in water at normal temperature and pressure should be greater than 1%, relative to the water by mass.

In the invention the amount of the above water soluble multi-valent metal salt compounds included in the ink receiving layer is preferably 0.1 to 10% by mass relative to the particles, and more preferably 1 to 5% by mass.

The above water soluble multi-valent metal salt compounds can be used alone but they are preferably used in combinations of two or more.

By having the above mordants at least in the upper portion of the ink receiving layer, due to the interaction of the anionic dyes used as the coloring materials in the inkjet liquid inks, the coloring material can be stabilized and the water resistance and tendency to bleed after a lapse of time can be improved.

For the above cationic mordants, polymer mordants with cationic groups of primary, secondary or tertiary amino groups, or quaternary ammonium salt groups are well suited but non-polymer mordants which are cationic also can be used.

For the above polymer mordants, preferable are single polymers of monomers with primary, secondary or tertiary amino groups or salts thereof, or quaternary ammonium salt groups (referred to below as mordant monomers), and copolymers or condensation polymers of the mordant monomers with other monomers (referred to below as non-mordant monomers). Also, these polymer mordants can be used in the form of either water soluble polymers, or water dispersible latex particles.

Examples of the above mordant monomer include trimethyl-p-vinylbenzylammonium chloride, trimethyl-m-vinylbenzylammonium chloride, triethyl-p-vinylbenzyl ammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinyl benzyl ammonium chloride, N,N-diethyl-N-benzyl-N-p-vinylbenzylammonium chloride, N,N-dimethyl-N-(4-methyl) benzyl-N-p-vinylbenzylammonium chloride, N,N-dimethyl-N-phenyl-N-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzyl ammonium acetate, N,N,N-triethyl-N-2-(4-vinylphenyl) ethylammonium chloride, N,N,N-triethyl-N-2-(3-vinylphenyl)ethylammonium chloride, N,N-diethyl-N-methyl-N-2-(4-vinylphenyl)ethylammonium chloride, N,N-diethyl-N-methyl-N-2-(4-vinylphenyl)ethylammonium acetate; quaternary compounds obtained by reacting methyl chlorides, ethyl chlorides, methyl bromides, ethyl bromides, methyl iodides, or ethyl iodides of N,N-dimethylaminoethyl (meth)acrylate, N,N-diethylaminoethyl(meth)acrylate, N,N-dimethylaminopropyl(meth)acrylate, N,N-diethylaminopropyl(meth)acrylate, N,N-dimethylaminoethyl(meth) acrylamide, N,N-diethylaminoethyl(meth)acrylamide, N,N-dimethylaminopropyl(meth)acrylamide, or N,N-diethylaminopropyl(meth)acrylamide; and sulfonates, alkyl sulfonates, acetates, or alkyl carboxylates derived from the quaternary compounds by replacement of the anion.

Specific examples of such compounds include monomethyldiallylammonium chloride, trimethyl-2-(methacryloyloxy) ethylammonium chloride, triethyl-2-(methacryloyloxy)ethylammonium chloride, trimethyl-2-(acryloyloxy) ethylammonium chloride, triethyl-2-(acryloyloxy) ethylammonium chloride, trimethyl-3-(methacryloyloxy) propylammonium chloride, triethyl-3-(methacryloyloxy) propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino) propylammonium chloride, trimethyl-2-(methacryloyloxy) ethyl ammonium bromide, trimethyl-3-(acryloylamino) propylammonium bromide, trimethyl-2-(methacryloyloxy) ethylammonium sulfonate, and trimethyl-3-(acryloylamino) propylammonium acetate.

Examples of other copolymerizable monomers include N-vinylimidazole and N-vinyl-2-methylimidazole.

Further, allylamine, diallyamine, and derivatives and salts thereof may also be used. Examples of these compounds include allylamine, allylamine hydrochloride, allylamine acetate, allylamine sulfate, diallyamine, diallyamine hydrochloride, diallyamine acetate, diallyamine sulfate, diallylmethylamine and the salts thereof (e.g., hydrochloride, acetate, and sulfate salts, and the like), diallylethylamine and the salts thereof (e.g., hydrochloride, acetate, and sulfate salts, and the like), diallyldimethylammonium salts (counter anions thereof including chloride, acetate, and sulfate ions), and the like. These allylamine and diallyamine derivatives are less polymerizable in the amine form, and thus are commonly polymerized in the salt form and desalted thereafter if necessary.

Further, polymerization units of N-vinylacetamide and N-vinylformamide can be used, to give vinylamine units by hydrolyzation after polymerization, or salts thereof can be used.

The term "a non-mordant monomer" refers to a monomer that does not have a basic or cationic moiety, such as a primary, secondary or tertiary amino group, a salt thereof, or a quaternary ammonium salt group, and exhibits no or substantially little interaction with dye in inkjet ink.

Examples of non-mordant monomers include alkyl ester (meth)acrylates; cycloalkyl ester (meth)acrylates such as cyclohexyl(meth)acrylate; aryl ester (meth)acrylates such as phenyl(meth)acrylate; aralkyl ester(meth)acrylates such as benzyl(meth)acrylate; aromatic vinyl compounds such as styrene, vinyltoluene and α-methylstyrene; vinyl esters such as vinyl acetate, vinyl propionate and vinyl versatate; allyl esters such as allyl acetate; halogen-containing monomers such as vinylidene chloride and vinyl chloride; vinyl cyanides such as (meth)acrylonitrile; and olefins such as ethylene and propylene.

The above alkyl ester (meth)acrylates preferably have 1 to 18 carbon atoms in the alkyl moiety. Examples of such alkyl ester (meth)acrylates include methyl(meth)acrylate, ethyl (meth)acrylate, propyl(meth)acrylate, isopropyl(meth)acrylate, n-butyl(meth)acrylate, isobutyl(meth)acrylate, tert-butyl(meth)acrylate, hexyl(meth)acrylate, octyl(meth)acrylate, 2-ethylhexyl(meth)acrylate, lauryl(meth)acrylate, and stearyl(meth)acrylate.

Particularly preferred are methyl acrylate, ethyl acrylate, methyl methacrylate, ethyl methacrylate, and hydroxyethyl methacrylate.

One kind of non-mordant monomer may be used alone or two or more kinds of non-mordant monomers may be used in combination.

Preferred examples of the polymeric mordant also include poly diallyldimethyl ammonium chloride, poly methacryloyloxyethyl-β-hydroxyethyldimethylammonium chloride, poly ethyleneimine, polyallylamine and modified derivatives thereof, polyallylamine hydrochloride, polyamide-polyamine resins, cationized starch, dicyandiamide formaldehyde condensates, dimethyl-2-hydroxypropylammonium salt polymers, polyamidine, polyvinylamine, and an acrylic cationic emulsion of an acryl silicone latex described in JP-A Nos. 10264511, 2000-43409, 2000-343811 and 2002-120452 ("AQUABRID ASi-781, ASi784, ASi-578 and ASi-903 (Trade Name) manufactured by Daicel Chem. Ind. Ltd.).

Regarding the molecular weights of the above mordants, the weight average molecular weight is preferably 2000 to 300,000. If the molecular weight is in this range, the water resistance and resistance to bleeding with the lapse of time can be further improved.

—Other Components—

The ink receiving layer may contain the following components if necessary.

To restrain the deterioration of the ink colorant, anti-fading agents such as various ultraviolet absorbers, antioxidants and singlet oxygen quenchers may be contained.

Examples of the ultraviolet absorbers include cinnamic acid derivatives, benzophenone derivative and benzotriazolyl phenol derivatives. Specific examples include α-cyano-phenyl butyl cinnamate, o-benzotriazole phenol, o-benzotriazole-p-chlorophenol, o-benzotriazole-2,4-di-t-butyl phenol, o-benzotriazole-2,4-di-t-octyl phenol. A hindered phenol compound can be also used as an ultraviolet absorber, and phenols in which at least one or more of the second position and/or the sixth position is substituted by a branched alkyl group is preferable.

A benzotriazole based ultraviolet absorber, a salicylic acid based ultraviolet absorber, a cyano acrylate based ultraviolet absorber, and oxalic acid anilide based ultraviolet absorber or the like can be also used. For instance, the ultraviolet absorbers as described in JP-A Nos. 47-10537, 58-111942, 58-212844, 59-19945, 59-46646, 59-109055 and 63-53544, Japanese Patent Application (JP-B) Nos. 36-10466, 42-26187, 48-30492, 48-31255, 48-41572 and 48-54965, 50-10726, U.S. Pat. Nos. 2,719,086, 3,707,375, 3,754,919 and 4,220,711 or the like.

An optical brightening agent can be also used as an ultraviolet absorber, and specific examples include a coumalin based optical brightening agent. Specific examples are described in JP-B Nos. 45-4699 and 54-5324 or the like.

Examples of the antioxidants are described in EP 223739, 309401, 309402, 310551, 310552 and 459416, D.E. Pat. No. 3435443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437 and 5-170361, JP-B Nos. 48-43295 and 48-33212, U.S. Pat. Nos. 4,814,262 and 4,980,275.

Specific examples of the antioxidants include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4,-tetrahydroquinoline, nickel cyclohexanate, 2,2-bis(4-hydroxyphenyl)propane, 1,1-bis(4-hydroxyphenyl)-2-ethylhexane, 2-methyl-4-methoxy-diphenylamine, 1-methyl-2-phenyl indole.

These anti-fading agents can be used singly or in combinations of two or more. The anti-fading agents can be dissolved in water, dispersed, emulsified, or they can be included within microcapsules. The amount of the anti-fading agents added is preferably 0.01 to 10% by mass, relative to the total ink receiving layer coating liquid.

In the invention, in order to prevent curl, it is preferable to include an organic solvent with a high boiling point in the ink receiving layer.

For the above high boiling point organic solvents, water soluble ones are preferable. Examples of the water soluble organic solvents with high boiling points include the following alcohols: ethylene glycol, propylene glycol, diethylene glycol, triethylene glycol, glycerin, diethylene glycol monobutylether (DEGMBE), triethylene glycol monobutyl ether, glycerin monomethyl ether, 1,2,3-butane triol, 1,2,4-butane triol, 1,2,4-pentane triol, 1,2,6-hexane triol, thiodiglycol, triethanolamine, polyethylene glycol (average molecular weight of 400 or less). Diethylene glycol monobutylether (DEGMBE) is preferable.

The amount of the above high boiling point organic solvents used in the coating liquid for the ink receiving layer is preferably 0.05 to 1% by mass, and particularly favorable is 0.1 to 0.6% by mass.

Also, for the purpose of increasing the dispersability of the inorganic pigment particles, various inorganic salts and pH adjusting agents such as acids or alkalis may be contained.

Further, in order to suppress the generation of on the surface of friction charging and exfoliation charging, conductive metallic compound particles, and matting agents, for reducing the surface friction, may be contained.

Support

In an embodiment of the inkjet recording medium according to the invention, the arithmetical mean deviation of the assessed profile Ra, as specified in JIS-B-0601(2001), of the support surface, determined with the evaluation length of 2.5 mm and the cutoff value of 0.8 mm, is 0.3 to 1.5 μm, and the peak value (reflectance) of the support surface, as determined by a goniophotometer, is in the range of 20 to 80%.

By controlling the arithmetical mean deviation of the assessed profile Ra and the peak value (reflectance) as determined by a goniophotometer of the support in the range above, it becomes easier to adjust the arithmetical mean deviation of the assessed profile Ra and the peak value (reflectance) as determined by a goniophotometer of the surface of the ink receiving layer formed on the support in the range above, and thus, to obtain an inkjet recording medium superior in sharpness, sense of depth and black depth.

As described above, the arithmetical mean deviation of the assessed profile Ra of the surface of the support according to the invention surface may be 0.3 to 1.5 μm, and is preferably 0.35 to 1.5 μm and more preferably 0.4 to 1.5 μm.

The peak value (reflectance) of the support according to the invention, as determined by a goniophotometer, may be in the range of 20 to 80%, and is preferably 20 to 70% and more preferably 20 to 60%.

The peak value (reflectance) as determined by a goniophotometer has the same meaning as that for the ink receiving layer described above, and the measuring condition is also the same.

An opaque support can be preferably used as the support. Examples of such opaque supports include paper supports having high glossiness such as art paper, coat paper, cast coat paper and baryta paper used for a support for a silver salt photography or the like; polyesters such as polyethylene terephthalate (PET), cellulose esters such as nitrocellulose, cellulose acetate and cellulose acetate butyrate, opaque high glossiness films which are constituted by incorporating white pigment or the like in plastic films such as polysulfone, polyphenylene oxide, polyimide, polycarbonate and polyamide (a surface calendar treatment may be performed); or, supports in which a coating layer made of polyolefin which either does or does not contain a white pigment is formed on the surface of a paper support, a transparent support or a high glossiness film containing a white pigment or the like. Also, white pigment-containing foam polyester film (for instance, a foam PET which contains the polyolefin particles, and contains voids formed by drawing out) is preferable.

The thickness of the opaque support is not particularly limited. However, a thickness of 50 to 400 μm is preferable in view of ease of handling.

One treated by corona discharge treatment, glow discharge treatment, flame treatment or ultraviolet radiation treatment or the like may be used for the surface of the support, so as to improve wetting and adhesion properties.

Next, base paper used for paper support will be described.

The base paper is mainly made of wood pulp, and is made by using a synthetic pulp, such as polypropylene, in addition to the wood pulp if necessary, or a synthetic fiber such as nylon or polyester. LBKP, LBSP, NBKP, NBSP, LDP, NDP, LUKP and NUKP can be used as the wood pulp. It is preferable to use a higher amount of LBKP, NBSP, LBSP, NDP and LDP which contain a lot of short fibers. The ratio of LBSP and/or LDP is preferably in the range of 10% by mass to 70% by mass.

A chemical pulp with few impurities (sulfate pulp and sulfite pulp) is preferably used as the pulp, and a pulp in which whiteness is improved by bleaching, is useful.

Sizing agents such as higher fatty acid and alkyl ketene dimer, white pigments such as calcium carbonate, talc and titanium oxide, paper reinforcing agents such as starch, polyacrylamide and polyvinyl alcohol, optical brightening agents, water retention agents such as polyethylene glycols, dispersing agents, and softening agents such as a quaternary ammonium can be appropriately added to the base paper.

The freeness of pulp used for papermaking is preferably 200 to 500 ml as stipulated in CSF. The sum of 24 mesh remainder portions and 42 mesh remainder portions is preferably 30 to 70% by mass as stipulated in JIS P-8207. 4 mesh remainder portion is preferably 20% by mass or less.

The basis weight of the base paper is preferably 30 to 350 g, and more preferably 50 to 300 g. The thickness of the base paper is preferably 40 to 350 μm. High smoothness can be imparted to the base paper by calendar treatment at the making paper step or after paper making. The density of the base paper is generally 0.7 to 1.2 g/m$^2$ (JIS P-8118). In addition, the strength of the base paper is preferably 20 to 250 g under the conditions of JIS P-8143.

A surface sizing agent may be coated on the surface of the base paper, and a sizing agent which is the same as the sizing agent which can be added to the base paper can be used as the surface sizing agent.

It is preferable that the pH of the base paper is 5 to 9 when measured by a hot water extraction method provided by JIS P-8113.

In general, the both front and rear surfaces of the base paper can be coated with polyethylene. Main examples of polyethylenes include low density polyethylene (LDPE) and/or high density polyethylene (HDPE) but others such as LLDPE and polypropylene can be also used in part.

Especially, in the polyethylene layer on the side on which the ink receiving layer is formed, it is preferable that rutile type or anatase type titanium oxide, an optical brightening agent or ultramarine blue pigment is added to polyethylene, and thereby the degree of opaqueness, whiteness and hue are improved, as is widely performed for printing papers for photographs. Herein, the content of titanium oxide is preferably about 3 to 20% by mass, and more preferably 4 to 13% by mass relative to polyethylene. The thickness of the polyethylene layer is not particularly limited, and the thickness of each of the front and rear face polyethylene layers is preferably 10 to 50 μm.

Further, an undercoat layer can be formed to give adhesion of the ink receiving layer on the polyethylene layer. Aqueous polyester, gelatin, and PVA are preferably used as the undercoat layer. The thickness of the undercoat layer is preferably 0.01 to 5 μm.

A polyethylene coated paper sheet may be used as glossy paper, or when polyethylene is coated on the base paper sheet by melt-extrusion, a matte surface or silk finish surface may be formed by applying an embossing treatment, as obtainable in usual photographic printing paper sheets.

Examples of the supports in the present embodiment include all base materials on which an ink receiving layer can be formed, including transparent supports of a transparent material such as plastic film and opaque supports such as paper, wherein the transparent or opaque material is previously subjected to application of the polyethylene layer described above, processing with the surface sizing agent above, application of the undercoat layer, the surface modification treatment, or other treatments, and thus, the support is not particularly limited, if an ink receiving layer can be formed thereon.

The support according to the invention is, for example, prepared by coating a polyolefin resin on the surface of a base paper by melt-extruding and applying embossing treatment with a chill roll.

The chill roll is prepared by plating the surface of a roll with a metal such as copper, nickel, rhodium, brass, chromium, or cobalt, buffing the surface by glass bead or sand blasting, metal-plating the surface, and thus, adjusting the surface roughness Rz thereof to 5 to 25 μm, preferably 5 to 20 μm, Inkjet Recording Medium Production The ink receiving layer of the inkjet recording medium of the invention is preferably formed by, for example, applying at least a coating liquid (the first coating liquid) onto a surface of the support to form a coating layer; adding a crosslinking agent to the coating liquid (coating liquid 1) and/or to a basic solution (coating liquid 2) having a pH value of 7.1 or above; and either (1) at the same time as forming the coating layer by applying the coating liquid (first coating liquid), or (2) during the drying of the coating layer formed by applying the coating liquid (first coating liquid) and before the coating layer exhibits a decreasing rate of drying, applying the basic solution (second coating liquid) onto the coating layer to crosslink and cure the coating layer (a so called "Wet on Wet" method).

The above crosslinking agent which can crosslink the water soluble resin is preferably added to one or both of the first coating liquid or second coating liquid. Forming the ink receiving layer by crosslinking and curing in this way by applying the basic solution (second coating liquid) to the first coating liquid (1) at the same time, or (2) during drying is particularly preferable to improve the appearance, from the perspective of the ink absorption ability and prevention of cracks in the film, as well as cissing defects.

The mordant is included such that a thickness from the surface of the ink receiving layer of the portion containing the mordant accounts for preferably 10 to 60% of the total thickness of the ink receiving layer. For example, either of these methods can be selected: (1) forming a coating layer containing the particles, the water-soluble resin and crosslinking agent, followed by coating a mordant-containing solution thereon; or (2) multi-coating, by applying the coating liquid containing the particles and water-soluble resin, at the same time as coating the mordant-containing solution. Also, inorganic particles, water-soluble resin and crosslinking agent may be added to the mordant-containing solution. Forming by the above methods is preferable since significant amount of mordant is then present in a specific portion of the ink receiving layer, and so the ink coloring material of the inkjet can be sufficiently mordanted, and the color density, the tendency to bleed with the lapse in time, glossiness of the printed areas, the water resistance of text and images after printing, and the resistance to ozone can be further improved. A portion of the mordant can contained in a layer provided at first on the support. In this case the mordant applied later can be the same mordant or a different mordant.

In an embodiment, the coating liquid (first coating liquid) containing inorganic pigment particles and water soluble resin or a boron compound (crosslinking agent), can be prepared as set out below.

Silica particles with a uniform average particle diameter of 20 nm or below can be added to water (for example, to a silica particle concentration in water of 10 to 20% by mass), dispersing the particles using a high speed rotational wet-type colloid mill (such as trade name: CLEARMIX, manufactured by M Technique Co., Ltd.) at a high speed rotation of 10,000 rpm (preferably, at 5,000 to 20,000 rpm) for 20 minutes (preferably, for 10 to 30 minutes), then adding a boron compound (for example at a rate of 0.5 to 20% by mass, relative to the silica), dispersing under the same conditions as above, adding an aqueous polyvinyl alcohol (PVA) solution (to make the PVA concentration become about ⅓ of the concentration of the silica), and again dispersing under the same conditions as described above. The thus obtained coating liquid is in the state of a uniform sol, and by applying the liquid onto the support by the method described below, a porous ink receiving layer having a three-dimensional network structure can be formed.

Where necessary pH adjusting agents, a dispersants, surfactants, anti-foaming agents, anti-static agents and the like can be added to the above first liquid.

Dispersing machines used for the dispersion include various known dispersing machines such as a high speed rotational dispersing machine, medium agitating-type dispersing machine (such as a ball mill and a sand mill), ultrasonic dispersing machine, colloid mill dispersing machine and high pressure dispersing machine. However, the medium agitating-type dispersing machine, colloid mill dispersing machine and high pressure dispersing machine are preferable for efficiently dispersing coagulates of the particles.

Water, organic solvents and mixed solvents thereof may be used as the solvent in each coating liquid. Examples of the organic solvent used for preparing a coating liquid include alcohols such as methanol, ethanol, n-propanol, i-propanol and methoxypropanol, ketones such as acetone and methylethyl ketone, tetrahydrofuran, acetonitrile, ethyl acetate and toluene.

In an embodiment, the second coating liquid (basic solution) containing surfactant(s) can, for example, be prepared as set out below. That is, a mordant (for example 0.1 to 5.0% by mass) and surfactant(s) (for example to a total amount of 0.01 to 1.0% by mass) and, where required, a crosslinking agent (0 to 5.0% by mass) is added to ion exchange water and agitated sufficiently. The pH of the second coating liquid is preferably 8.0 or above, and by using a pH adjuster such as aqueous ammonia, sodium hydroxide, potassium hydroxide or amino group-containing compound (such as ethyl amine, ethanol amine, diethanol amine, or polyallylamine), the pH can be set to 8.0 or above.

The first coating liquid (coating liquid for the ink receiving layer) can be coated by a known method, such as using an extrusion die coater, a slot coater, a curtain coater, an air doctor coater, a blade coater, a rod coater, a knife coater, a squeeze coater, a reverse roll coater, or a bar coater. A known method such as a extrusion die coater, a slot coater, and a curtain coater are preferably used.

While the second coating liquid (basic coating liquid) is applied on the coating layer simultaneously with or after applying the first coating liquid (coating liquid for ink receiving layer), the second coating liquid may be applied before the coating layer exhibits a decreasing (falling) rate of drying. In other words, the ink receiving layer is favorably formed by providing the basic solution before the coating layer exhibits falling rate of drying after applying the first coating liquid for the ink receiving layer. A mordant may be added to the second coating liquid.

The phrase "before the coating layer exhibits a decreasing (falling) rate of drying" usually means a process within several minutes from immediately after applying the coating liquid of the ink receiving layer. During this period the content of the solvent (dispersing medium) in the applied coating liquid decreases in proportion to the lapse of time (a constant rate period of drying). The time lapse exhibiting "constant rate period of drying" is described, for example, in Kagaku Kogaku Binran (Chemical Engineering Handbook), pp. 707-712, Maruzen Co. Ltd., 25 Oct., 1980.

The period in which the coating layer is dried until it exhibits a falling rate of drying after applying the first coating liquid, is usually, at 50 to 180° C., for 0.5 to 10 minutes (preferably, 0.5 to 5 minutes). While this drying time differs depending on the amount of coating, the aforementioned range is usually appropriate.

Examples of the method for applying the coating liquid before the coating layer exhibits a falling rate of drying include (1) further coating the second coating liquid on the coating layer, (2) spraying the second coating liquid, and (3) dipping the support on which the coating layer has been disposed in the second coating liquid.

The method used for applying the second coating liquid in the above method (1) includes known application method using, for example, a curtain flow coater, an extrusion die coater, an air doctor coater, a blade coater, a rod coater, a knife coater, a squeeze coater, a reverse roll coater and a bar coater. The extrusion die coater, curtain flow coater or bar coater is preferably used to prevent the coater from contacting with the already formed first coating layer.

The coating amount of the second coating liquid is generally 5 to 50 g/m$^2$, and preferably 10 to 30 g/m$^2$.

After application of the second coating liquid, generally drying and curing is carried out at 40 to 180° C. for 0.5 to 30 minutes. Heating at a temperature of 40 to 150° C. for 1 to 20 minutes is preferable. For example, when borax or boric acid is included in the first coating liquid as a crosslinking agent, then carrying out heating to a temperature of 60 to 100° C. for 5 to 20 minutes is preferable.

When the basic solution (second coating liquid) is applied simultaneously with applying the coating liquid (first coating liquid) for the ink receiving layer, the first coating liquid and second coating liquid are simultaneously provided on the support so that the first coating liquid contacts the support (multi-layer coating), and then the liquids are dried to thereby form the ink receiving layer.

Coating methods using, for example, an extrusion die coater or a curtain flow coater may be employed for simultaneous application (multilayer coating). When the coated layers are dried after the simultaneous coating, these layers are usually dried by heating at 40 to 150° C. for 0.5 to 10 minutes, and preferably by heating at 40 to 100° C. for 0.5 to 5 minutes.

When the coating liquids are simultaneously applied (multi-layer coating) using, for example, an extrusion die coater, the simultaneously supplied two coating liquids are laminated at near the outlet of the extrusion die coater, or immediately before the liquids are transferred onto the support, and are laminated on the support to make a dual layer. Since the two layers of the coating liquids laminate before application onto the support, they tend to undertake crosslinking at the interface between the two liquids while the solutions are transferred onto the support. This results in the supplied two liquids readily become viscous by being mixed with each other in the vicinity of an outlet of the extrusion die coater, occasionally leading to trouble in the coating operation. Accordingly, it is preferable to arrange triple layers by presenting a barrier layer liquid (intermediate layer liquid) between the two liquids, and to apply simultaneously the three liquids (multi-layer coating).

The barrier-layer liquid can be selected without particularly limitations, and examples thereof include an aqueous solution containing a trace amount of water-soluble resin, water, and the like. The water-soluble resins are used considering the coating property of the solution, for example, for increasing the viscosity of the solution, and examples thereof are polymers including cellulosic resins (e.g., hydroxypropylmethylcellulose, methylcellulose, hydroxyethylmethyl cellulose, and the like), polyvinylpyrrolidone, gelatin, and the like. The barrier-layer liquid may also contain a mordant.

After forming on the support, the ink receiving layer may be subjected to calendering by passing through roll nips under heat and pressure, for example, by using a super calender or gloss calender, or the like, for improvement in the surface smoothness, glossiness, transparency, and strength of the coating layer. However, because calendering sometimes causes decrease in void ratio (i.e., decrease in ink absorptive property), it is necessary carry out calendering under conditions set to reduce the decrease in void percentage.

The roll temperature during calendering is preferably 30 to 150° C., more preferably 40 to 100° C., and the linear pressure between rolls during calendering is preferably 50 to 400 kg/cm, and more preferably 100 to 200 kg/cm.

In the invention the thickness of the ink receiving layer should be decided, in the case of inkjet recording, according to the void percentage of the layer, as the layer preferably has a sufficient absorption capacity allowing absorption of all droplets. For example, if the ink quantity is 8 nl/mm$^2$ and the void percentage is 60%, a film having a thickness of about 15 μm or more is preferable. Considering the above, ink receiving layer for inkjet recording preferably has a thickness of 10 to 50 μm.

In addition, the median diameter of the pores in the ink receiving layer is preferably 0.005 to 0.030 μm, and more preferably 0.01 to 0.025 μm. The void percentage and the pore median size may be determined by using a mercury porosimeter (trade name: "PORESIZER 9320-PC2", manufactured by Shimadzu Corporation).

EXAMPLES

Hereinafter, the present invention will be described in detail with reference to Examples, but it should be understood that the invention is not restricted by the following Examples. The "part" and "%" below mean respectively "part by mass" and "% by mass".

Example 1

Preparation of Chill Roll A

A chill roll A having a final surface roughness Rz of 10 μm was prepared by plating the surface of a roll with copper and nickel, blasting the surface with glass beads or sand to emboss the surface, buffing the surface, and plating the surface additionally with nickel chrome.

—Preparation of Support—

Stocks of acacia LBKP and aspen LBKP, which are previously adjusted to a Canadian freeness of 300 ml by using a disk refiner, were mixed at a ratio of 50:50 by mass. To the pulp slurry, added were 1.3% by mass of a cationic starch (CATO 304L, manufactured by Japan NSC), 0.15% by mass of an anionic polyacrylamide (POLYACRON ST-13, manufactured by Seiko Chemicals, Co., Ltd.), 0.29% by mass of an alkylketene dimer (SIZEPINE K, manufactured by Arakawa Kasei Co., Ltd.), 0.8% by mass of epoxidized behenic amide, and 0.32% by mass of polyamide polyamine epichlorohydrin (ARAFIX 100, manufactured by Arakawa Kasei Co., Ltd.), and then, 0.12% by mass of an antifoam.

The pulp slurry thus prepared was made into a paper using a Fourdrinier machine, and processed in a dryer, a size press, and a machine calender, to give a base paper having a basis weight of 174 g/m$^2$, a thickness of 170 μm, and a water content of 7.5%. The composition of the size press solution was as follows:

Polyvinyl alcohol (KL-118, manufactured by Kuraray Co., Ltd.) 2 parts by mass

Sodium chloride 1 part by mass

The concentration of the size press solution was adjusted to 5%, and the solution was coated on both faces of the paper to a dry coating amount of 1.25 g/m$^2$.

The rear face of the base paper obtained was corona-discharged, and coated with a polyethylene having a density of 0.96 g/cm$^2$ to a coating amount of 29 g/m$^2$, to form a mat-surfaced thermoplastic resin layer.

The front face was then corona-discharged, and a low-density polyethylene having a density of 0.93 g/cm$^2$ containing 20% by mass of anatase titanium oxide, 0.3% of ultramarine, and 0.08% of an optical brightening agent "WHITEFLOUR PSN CONC." (manufactured by Nippon Chemical Industrial Co., Ltd.) was coated thereon to a coating amount of 24 g/m$^2$. The film was then subjected to embossing with the chill roll A described above.

—Preparation of Coating Liquid a for Ink Receiving Layer—

(1) vapor-phase silica particles, (2) ion-exchange water, (3)"SHAROLL DC-902P", and (4) "ZA-30" in the following composition were mixed, and the mixture was dispersed in a homomixer (T. K. HOMODISPER, manufactured by Tokushu Kika Kogyo Co., Ltd.) at a frequency of 4,000 rpm at 30° C. for 2 hours, to give a coarse silica dispersion. The coarse dispersion was redispersed in a liquid-liquid collision dispersing machine (ULTIMIZER, manufactured by Sugino Machine Ltd.) at 130 MPa and in one pass, to give a fine silica dispersion. Then, (5) boric acid, (6) a PVA solution, (7) "SUPERFLEX 600", (8) polyoxyethylene laurylether, and (9) ethanol were added thereto at 30° C., to give an ink receiving layer coating liquid A.

—Composition of Ink Receiving Layer Coating Liquid A—

(1) Vapor-phase silica particles (inorganic particles) 10.0 parts (AEROSIL 300SF75; manufactured by Nippon Aerosil Co., Ltd.)
(2) Ion-exchange water 64.8 parts
(3) SHAROLL DC-902P (51.5% aqueous solution) 0.87 part (dispersant; manufactured by Daiichi Kogyo Seiyaku Co., Ltd.)
(4) Zircosol "ZA-30" (zirconyl acetate) 0.54 part (manufactured by Daiichi Kigenso Kagakukogyo Co., Ltd.)
(5) Boric acid (crosslinking agent) 0.37 part
(6) Polyvinyl alcohol (water-soluble resin) solution 29.4 parts (Composition of the povinyl alcohol solution)
PVA235 (manufactured by Kuraray Co., Ltd.) 2.03 parts
Polyoxyethylene lauryl ether (surfactant) 0.03 part
Diethylene glycol monobutyl ether 0.68 part
(BUTYCENOL 20P; manufactured by Kyowa Hakko Chemical Co., Ltd.)
Ion-exchange water 26.6 parts
(7) "SUPERFLEX 600" 1.24 parts (manufactured by Daiichi Kogyo Seiyaku Co., Ltd.)
(8) Polyoxyethylene lauryl ether 0.49 part ("EMULGEN 109P" (10% aqueous solution, manufactured by Kao Corp.)
(9) Ethanol 2.49 parts (Preparation of Inkjet Recording Sheet (Inkjet Recording Medium))

The front face of the support above was corona-discharged, and the ink receiving layer coating liquid A was coated thereon to an coating amount of 173 ml/m$^2$, and an aqueous 5 time-diluted polyaluminum chloride solution (ALFINE 83; manufactured by Taimei Chemicals Co., Ltd.) was coated in line at a speed of 10.8 ml/m$^2$. The resulting layer was dried in a hot air dryer at 80° C. to a coating layer solid matter concentration of 20%. The coating layer exhibited a constant drying rate then. Before the coating layer exhibit a falling drying rate, it was immersed in a basic solution B having the following composition for 3 seconds, allowing the solution to deposit on the coating layer in an amount of 13 g/m$^2$, and the resulting layer was dried at 80° C. for 10 minutes (hardening step), to give an ink receiving layer having a dry film thickness of 32 μm.

(Composition of Basic Solution B)

(1) Boric acid 0.65 part (2) Zirconium ammonium carbonate 2.5 parts (ZIRCOSOL AC-7 (28% aqueous solution), manufactured by Daiichi Kigenso Kagaku Kogyo Co., Ltd.)

(3) Ammonium carbonate (manufactured by Kanto Kagaku Co. Inc., reagent grade 1) 3.5 parts (4) Ion-exchange water 63.3 parts (5) Polyoxyethylene laurylether 30.0 parts ("EMULGEN 109P" (2% aqueous solution, manufactured by Kao Corp.))

Example 2

Preparation of Chill Roll B

A chill roll B having a final surface roughness Rz of 14 μm was prepared by plating the surface of a roll with copper and nickel, blasting the surface with glass beads or sand to emboss the surface, buffing the surface, and plating it with nickel chrome.

A support of Example 2 was prepared by using the chill roll B, replacing the chill roll A obtained in the "Preparation of support" of Example 1. An inkjet recording sheet (inkjet recording medium) of Example 2 was prepared in the same manner as in Example 1, except that the support of Example 2 was used.

Example 3

Preparation of Chill Roll C

A chill roll C having a final surface roughness Rz of 7 μm was prepared by plating the roll surface with copper and nickel, blasting the surface with glass beads or sand to emboss the surface, buffing the surface, and plating it with nickel chrome.

A support of Example 3 was prepared by using the chill roll C, replacing the chill roll A obtained in the "Preparation of support" of Example 1. An inkjet recording sheet (inkjet recording medium) of Example 3 was prepared in the same manner as in Example 1, except that the support of Example 3 was used.

Comparative Example 1

Preparation of Chill Roll D

A chill roll D having a final surface roughness Rz of 10 μm was prepared by plating the roll surface with copper and nickel, blasting the surface with glass beads or sand to emboss the surface, and buffing the surface.

A support of Comparative Example 1 was prepared by using the chill roll D, replacing the chill roll A obtained in the "Preparation of support" of Example 1. An inkjet recording sheet (inkjet recording medium) of Comparative Example 1 was prepared in the same manner as in Example 1, except that the support of Comparative Example 1 was used.

Comparative Example 2

Preparation of Chill Roll E

A chill roll E having a final surface roughness Rz of 0.7 μm was prepared by plating the roll surface with chrom, blasting the surface with glass beads or sand to emboss the surface, and buffing the surface.

A support of Comparative Example 2 was prepared by using the chill roll E, replacing the chill roll A obtained in the "Preparation of support" of Example 1. An inkjet recording sheet (inkjet recording medium) of Comparative Example 2 was prepared in the same manner as in Example 1, except that the support of Comparative Example 1 was used.

Evaluation Tests (1) Surface Roughness

The arithmetical mean deviation of the assessed profile (Ra), as specified in JIS-B-0601(2001), of the surfaces of the ink receiving layer and the support were determined by using TENCOR P-11 manufactured by KLA-Tencor Co., Ltd. The evaluation length was 2.5 mm and the cutoff value was 0.8 mm.

(2) Peak Value (Reflectance) as Determined by Goniophotometer

The peak values (reflectance) of the surfaces of the ink receiving layer and the support were determined by using a goniophotometer, a three-dimensional goniophotometer GP-200 manufactured by Murakami Color Research Laboratory Co., Ltd., under the following condition. The peak value is the average of the values of the sample in machine direction (MD) and cross direction (CD).

(Condition)

Light-source aperture: 6 (Φ21 mm)

Photodetector aperture: 2 (Φ4.5 mm)

S/S polarization

High Volt: 600

Filter: ND10

Incident angle: 45 degree

Measurement range: −30 to 90 degree

Sample inclination angle: 0 degree

Other conditions are the same as those described in the operation manual of GP-200 of the manufacturer.

(3) Evaluation of Image Quality 1 (Sharpness, Sense of Depth, and Black Depth)

A bright outdoor view image (EV: 16) and a night-view image (EV: 3) were printed on each of the inkjet recording media obtained in Examples and Comparative Examples by using inkjet printers (G-820, manufactured by Seiko Epson Corp. and HP DESIGN JET 30, manufactured by Hewlett-Packard Development Company, LP.), and the sharpness, sense of depth, and black depth thereof were evaluated by visual observation according to the following criteria. Results are summarized in Table 1.

A: Very favorable.

B: Favorable.

C: Slightly unfavorable

D: Unfavorable (4) Evaluation of Image Quality 2 (Facial Shininess)

An indoor portrait image ((EV: 10) was printed on each of the inkjet recording media obtained in Examples and Comparative Examples by using inkjet printers (G-820, manufactured by Seiko Epson Corp. and HP DESIGN JET 30, manufactured by Hewlett-Packard Development Company, LP.), and the facial shininess thereof was evaluated by visual observation according to the following criteria. Results are summarized in Table 1.

(Criteria)

A: Very favorable.

B: Favorable.

C: Slightly unfavorable

D: Unfavorable

TABLE 1

| | Support | | Ink receiving layer | | Bright outdoor view (EV value: 16) | | | Indoor portrait image (EV: 10) | Night view (EV value: 3) | | |
|---|---|---|---|---|---|---|---|---|---|---|---|
| | Surface roughness Ra (μm) | Peak value reflectance (%) | Surface roughness Ra (μm) | Peak value reflectance (%) | Sharpness | Sense of depth | Black depth | Facial shininess | Sharpness | Sense of depth | Black depth |
| Example 1 | 1.13 | 31.2 | 0.69 | 50.8 | B | B | B-A | B | B-A | A | A |
| Example 2 | 1.42 | 19.1 | 1.18 | 31.7 | B | B | B-A | B | B-A | A | A |
| Example 3 | 0.41 | 50.4 | 0.32 | 77.5 | B | B | B-A | B-C | B-A | A | A |
| Comparative Example 1 | 1.13 | 9.6 | 0.69 | 14.8 | C-D | C-D | C-D | B | C-D | C-D | C-D |
| Comparative Example 2 | 0.21 | 83.1 | 0.14 | 92.3 | B | B | B | D | B | B-A | B |

As apparent from Table 1, the inkjet recording sheets obtained in Examples 1 to 3 were superior in sharpness, sense of depth, and black depth independently of the EV value, while the inkjet recording sheets obtained in Comparative Examples 1 to 2 could not satisfy all of these evaluation items at the same time. In particular, the inkjet recording sheets of Examples 1 to 3 gave extremely favorable results in evaluation of the night view images having a smaller EV value.

The invention provides an inkjet recording medium superior in sharpness, sense of depth, and black depth, and especially superior in the quality of photographic images taken under darker exposure conditions such as night view images.

Hereinafter, embodiments of the invention will be described. However, the invention is not limited to these embodiments.

[1] An inkjet recording medium, comprising a support and an ink receiving layer formed on at least one face of the support, wherein the inkjet recording medium satisfies at least one of the following conditions (i) and (ii):

(i) the arithmetical mean deviation of the assessed profile Ra, as specified in JIS-B-0601(2001), of a surface of the ink receiving layer, determined with an evaluation length of 2.5 mm and a cutoff value of 0.8 mm, is 0.3 to 1.2 μm, and the peak value (reflectance) of the surface of the ink receiving layer, as determined by a goniophotometer, is in the range of 30 to 80%; and (ii) the arithmetical mean deviation of the assessed profile Ra, as specified in JIS-B-0601(2001), of a surface of the support, determined with an evaluation length of 2.5 mm and a cutoff value of 0.8 mm, is 0.3 to 1.5 μm, and the peak value (reflectance) of the surface of the support, as determined by a goniophotometer, is in the range of 20 to 80%.

[2] The inkjet recording medium of embodiment [1], satisfying condition (i).

[3] The inkjet recording medium of embodiment [1], satisfying condition (ii).

[4] The inkjet recording medium of embodiment [1], satisfying conditions (i) and (ii).

[5] The inkjet recording medium of embodiment [1], wherein the ink receiving layer comprises: at least one water-soluble resin selected from the group consisting of polyvinyl alcohol resins, cellulosic resins, ether bond-containing resins, carbamoyl group-containing resins, carboxyl group-containing resins, and gelatins; and particles of at least one selected from the group consisting of silica particles, colloidal silica, alumina particles, and pseudoboehmite.

[6] The inkjet recording medium of embodiment [1], wherein the arithmetical mean deviation of the assessed profile Ra of the ink receiving layer surface under condition (i) is 0.35 to 1.2 μm.

[7] The inkjet recording medium of embodiment [1], wherein the peak value (reflectance) as determined by a goniophotometer of the ink receiving layer surface under condition (i) is in the range of 30 to 75%.

[8] The inkjet recording medium of embodiment [1], wherein the arithmetical mean deviation of the assessed profile Ra of the ink receiving layer surface under condition (ii) is 0.35 to 1.5 μm.

[9] The inkjet recording medium of embodiment [1], wherein the peak value (reflectance) as determined by a goniophotometer of the ink receiving layer surface under condition (ii) is in the range of 20 to 70%.

[10] The inkjet recording medium of embodiment [5], wherein the water-soluble resin is a polyvinyl alcohol resin.

The disclosure of Japanese Patent Application No. 2005-146636 is incorporated herein by reference in its entirety.

All publications, patent applications, and technical standards mentioned in this specification are herein incorporated by reference to the same extent as if each individual publication, patent application, or technical standard was specifically and individually indicated to be incorporated by reference.

The invention claimed is:

1. An inkjet recording medium, comprising a support and an ink receiving layer formed on at least one face of the support, wherein the inkjet recording medium satisfies the following conditions (i) and (ii):

(i) the arithmetical mean deviation of the assessed profile Ra, as specified in JIS-B-0601(2001), of a surface of the ink receiving layer, determined with an evaluation length of 2.5 mm and a cutoff value of 0.8 mm, is 0.3 to 1.2 μm, and the peak value (reflectance) of the surface of the ink receiving layer, as determined by a goniophotometer, is in the range of 30 to 80; and (ii) the arithmetical mean deviation of the assessed profile Ra, as specified in JIS-B-0601(2001), of a surface of the support, determined with an evaluation length of 2.5 mm and a cutoff value of 0.8 mm, is 0.3 to 1.5 μm, and the peak value (reflectance) of the surface of the support, as determined by a goniophotometer, is in the range of 20 to 80.

2. The inkjet recording medium of claim 1, wherein the ink receiving layer comprises: at least one water-soluble resin selected from the group consisting of polyvinyl alcohol resins, cellulosic resins, ether bond-containing resins, carbamoyl group-containing resins, carboxyl group-containing resins, and gelatins; and particles of at least one selected from the group consisting of silica particles, colloidal silica, alumina particles, and pseudoboehmite.

3. The inkjet recording medium of claim 1, wherein the arithmetical mean deviation of the assessed profile Ra of the ink receiving layer surface under condition (i) is 0.35 to 1.2 μm.

4. The inkjet recording medium of claim 1, wherein the peak value (reflectance) as determined by a goniophotometer of the ink receiving layer surface under condition (i) is in the range of 30 to 75.

5. The inkjet recording medium of claim 1, wherein the arithmetical mean deviation of the assessed profile Ra of the support surface under condition (ii) is 0.35 to 1.5 μm.

6. The inkjet recording medium of claim 1, wherein the peak value (reflectance) as determined by a goniophotometer of the support surface under condition (ii) is in the range of 20 to 70.

7. The inkjet recording medium of claim 2, wherein the water-soluble resin is a polyvinyl alcohol resin.

8. The inkjet recording medium of claim 1, wherein the peak value (reflectance) of the ink receiving layer surface under condition (i), as determined by a goniophotometer, is in the range of 50.8 to 80.

9. The inkjet recording medium of claim 1, wherein the support is prepared using a chill roll, and wherein a surface of the chill roll is embossed by blasting with glass beads or sand.

10. The inkjet recording medium of claim 9, wherein the surface of the chill roll is plated with copper and nickel prior to embossing the chill roll.

11. The inkjet recording medium of claim 10, wherein the surface of the chill roll is plated with nickel chrome after embossing the chill roll.

12. The inkjet recording medium of claim 9, wherein the surface of the chill roll is plated with nickel chrome after embossing the chill roll.

* * * * *